US007926542B2

(12) United States Patent
Yang

(10) Patent No.: US 7,926,542 B2
(45) Date of Patent: Apr. 19, 2011

(54) LOW STRESS DEWAXING SYSTEM AND METHOD

(76) Inventor: Xi Yang, Greer, SC (US)

( * ) Notice: Subject to any disclaimer, the term of this patent is extended or adjusted under 35 U.S.C. 154(b) by 249 days.

(21) Appl. No.: 12/286,255

(22) Filed: Sep. 29, 2008

(65) Prior Publication Data

US 2009/0294086 A1 Dec. 3, 2009

Related U.S. Application Data

(60) Provisional application No. 61/130,497, filed on May 30, 2008.

(51) Int. Cl.
*B22C 9/04* (2006.01)
*B22C 17/00* (2006.01)

(52) U.S. Cl. ..... 164/36; 164/401; 164/246

(58) Field of Classification Search ..... 164/34, 164/35, 36, 44, 45, 516, 401, 235, 245, 246
See application file for complete search history.

(56) References Cited

U.S. PATENT DOCUMENTS

| | | | | |
|---|---|---|---|---|
| 1,364,124 | A * | 1/1921 | Lougheed | 164/36 |
| 1,914,718 | A * | 6/1933 | Hagman | 164/285 |
| 2,759,232 | A | 8/1956 | Demeter et al. | |
| 3,636,190 | A | 1/1972 | Horton | |
| 3,996,991 | A | 12/1976 | Ugata et al. | |
| 5,069,271 | A | 12/1991 | Chandley et al. | |
| 5,372,177 | A | 12/1994 | Foster | |
| 5,983,982 | A | 11/1999 | Vihtelic et al. | |
| 6,516,866 | B1 | 2/2003 | Jones | |
| 6,880,618 | B2 | 4/2005 | Goettsch et al. | |
| 6,889,745 | B2 | 5/2005 | Redemske | |
| 7,281,566 | B2 | 10/2007 | Chikugo et al. | |
| 2004/0134634 | A1 | 7/2004 | Yang et al. | |
| 2006/0237163 | A1 | 10/2006 | Turkington et al. | |
| 2007/0215315 | A1 | 9/2007 | Redemske et al. | |

FOREIGN PATENT DOCUMENTS

| | | | |
|---|---|---|---|
| JP | 07-314117 | A | 12/1995 |
| JP | 2005-131684 | A | 5/2005 |

OTHER PUBLICATIONS

International Searching Authority; International Search Report and Written Opinion; Korean Intellectual Property Office; Dec. 23, 2009; Seo-gu, Daejeon Korea; copy enclosed (11 pages).

* cited by examiner

*Primary Examiner* — Kevin P Kerns
(74) *Attorney, Agent, or Firm* — Harness, Dickey & Pierce, PLC

(57) ABSTRACT

A system and method for dewaxing is provided. The system includes a ceramic shell mold having a wall. Water is present within the wall of the ceramic shell mold. A wax pattern assembly is located within the ceramic shell mold. A heat source is configured for heating at least a portion of the wall of the ceramic shell mold in order to convert at least a portion of the water within the wall of the ceramic shell mold into steam for use in melting at least a portion of the wax pattern.

22 Claims, 8 Drawing Sheets

LOW STRESS DEWAXING SYSTEM AND METHOD

CROSS REFERENCE TO RELATED APPLICATION

This application claims the benefit of U.S. Application Ser. No. 61/130,497 filed on May 30, 2008 and entitled, "Low Stress Dewaxing System and Method." U.S. Application Ser. No. 61/130,497 is incorporated by reference herein in its entirety for all purposes.

FIELD OF THE INVENTION

The present invention relates generally to a system and method for use in removing wax from a ceramic shell mold. More particularly, the present application involves a system and method for removing wax in which the ceramic shell mold is saturated with water and then heated through use of a hot oil bath so that localized heating is imparted to the wax for low stress removal thereof.

BACKGROUND

Precision investment casting often involves the construction of a wax pattern assembly that is contained within a ceramic shell mold. The wax pattern assembly is removed from the ceramic shell mold and the resulting shell mold is subsequently filled with molten metal in a further step of the casting process. Removal of the wax pattern assembly from the ceramic shell mold may be effected through the use of heat that causes the wax to melt and thus drain out of the ceramic shell mold. The necessary heat may be obtained through placement of the wax pattern assembly and ceramic shell mold within a high pressure steam autoclave. As an alternate method of imparting heat to the combination, flash firing may be performed. Although capable of heating and therefore removing the wax, such processes may induce stresses into the ceramic shell mold and cause cracking and other defects. The wax pattern assembly has a higher rate of thermal expansion than the ceramic shell mold in which it is located. Heating of these components thus causes greater thermal expansion in the wax than in the ceramic shell mold. Disproportionate thermal expansion of the wax pattern assembly induces a hoop type pressure and stress on the ceramic shell mold thus causing cracks during the dewaxing process which can ultimately lead to metal casting run-outs, metal finning or dimensional scrap.

Precision investment casting parts sometimes include ceramic cores located inside of the wax pattern assembly that often have a complex, nonsymmetrical shape. The thickness of the wax pattern between the ceramic core and the ceramic shell mold is different at different locations. Dewaxing of the wax pattern assembly through the use of an autoclave or by flash firing causes the entire wax pattern surface to heat at the same time. The ceramic core is thus subjected to different pressures at different locations thereon. Pressure differentials on the ceramic core may cause it to shift or break during the dewaxing process. Further, a pressure differential is realized between the portions of the wax pattern assembly near the pour cup and those located farthest from the pour cup. The presence of the pour cup allows pressure to be relieved at those portions of the wax pattern assembly near the pour cup while a greater pressure is imparted to the wax pattern assembly remote from the pour cup. This pressure differential may cause the ceramic core to become dislodged.

In order to reduce defects caused by thermal expansion of the wax pattern assembly, the ceramic shell mold may be made of additional layers so that it is higher in strength and thus resistant to stresses imparted by the thermally expanded wax. However, the use of thicker ceramic shell molds may cause still further casting defects and scrap than if thinner ceramic shell molds were employed. Also, the use of thicker ceramic shell molds may make certain parts difficult or impossible to cast and may increase the cost of the casting process as additional material and time is needed.

Solutions to the aforementioned problems have been proposed in attempting a localized heating of the wax pattern assembly. One such method involves the introduction of a steam and surfactant mixture to a localized area of the wax pattern assembly. A localized temperature elevation is achieved to melt and drain the wax from the ceramic mold. Continued application of the steam and surfactant mixture causes the wax to be melted and drained from the ceramic mold in a progressive manner. The presence of the surfactant causes the liquid wax material to melt partially within the inner surface of the ceramic mold to thus act as a barrier to prevent steam condensate from soaking through the thickness of the ceramic mold and negatively affecting the binder present in the ceramic mold. Although capable of performing a dewaxing process, current methods are time consuming and costly and suffer from other inefficiencies. As such, there remains room for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
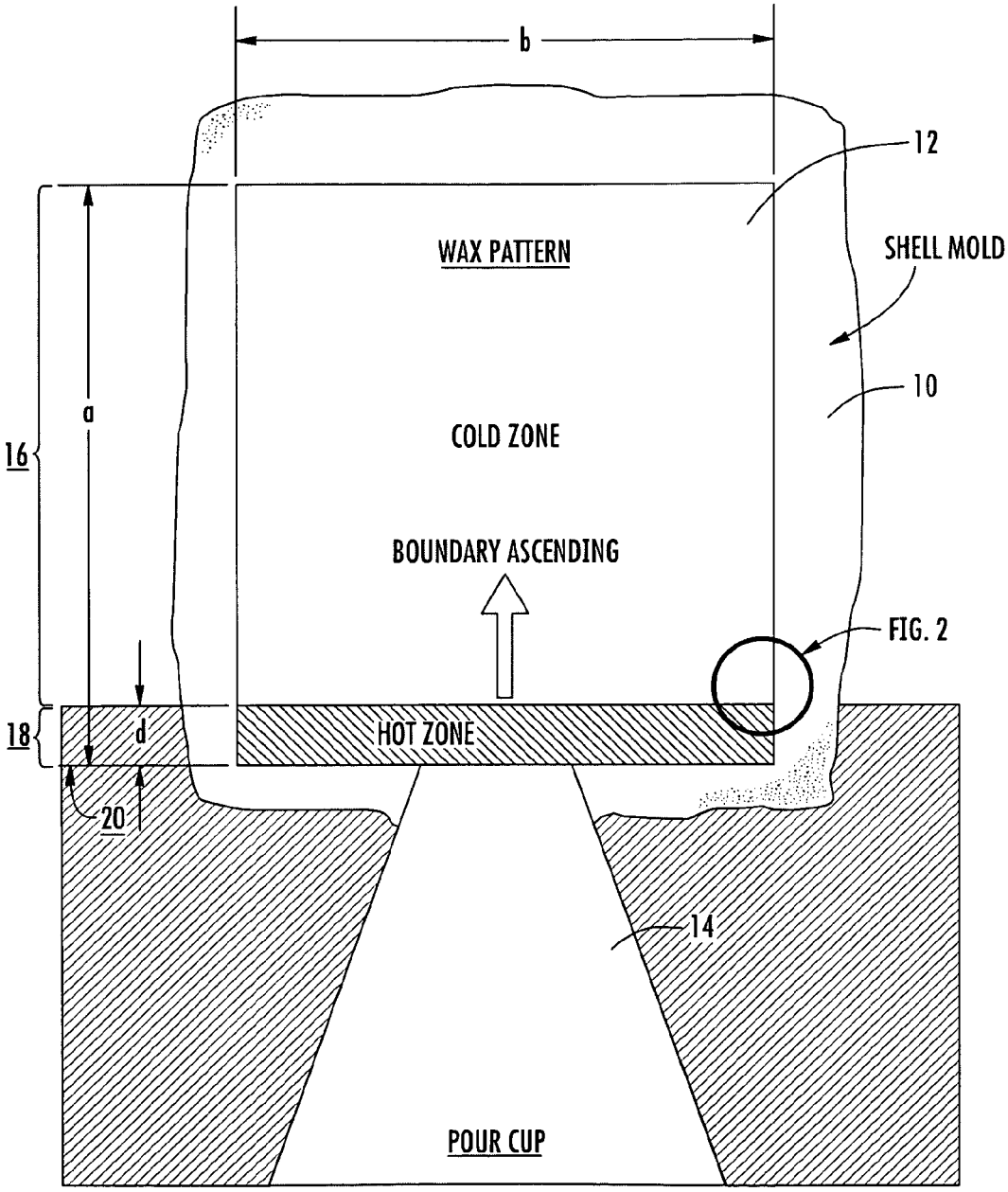
FIG. 1 is a side schematic view of a dewaxing process in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a system and method of dewaxing a ceramic shell mold 10 having a wax pattern assembly 12 contained therein. The system and method involve the wetting of the ceramic shell mold 10 so that is it saturated with water. The saturated ceramic shell mold 10 is immersed into a hot oil bath 20 in order to introduce localized heating to a portion of the ceramic shell mold 10. The heating of the ceramic shell mold 10 causes steam 22 to be generated due to the presence of the water in the ceramic shell mold 10 which is then directed into a portion of the wax pattern assembly 12 to induce localized heating. As only a portion of the wax pattern assembly 12 expands due to its temperature increase, stresses imparted onto the ceramic shell mold 10 are minimized. As such, the ceramic shell mold 10 may be less likely to crack and a ceramic core, if present, may be less likely to be displaced or otherwise damaged. Pressure differentials between external and internal surfaces of the ceramic shell mold 10 may be imparted into the system so that the generated steam 22 is directed into desired areas. The system and method may be employed with shell type investment casting. In accordance with certain exemplary embodiments, the system and method can be used with Directionally Solidified and Single Crystal casting.

FIG. 1 illustrates a system for dewaxing in accordance with one exemplary embodiment. A wax pattern assembly 12 is contained within a ceramic shell mold 10. The wax pattern assembly 12 is first formed and successive layers of ceramic slurries and particles are applied and dried to the wax pattern assembly 12 to form the ceramic shell mold 10 thereon. The wax pattern assembly 12 may be formed on a "tree" or other structure depending on the number, size and complexity of the wax pattern assembly 12 in certain embodiments and then subsequently applied with the ceramic. The system involves separating the wax pattern assembly 12 into a cold solid zone 16 that experiences little or no thermal expansion and thus imparts little or no stress onto the surrounding portions of the ceramic shell mold 10. Also formed is a hot, molten zone 18 of the wax pattern assembly 12 that is of a higher temperature than the cold zone 16. Heating of the wax pattern assembly 12 in the hot zone 18 causes the wax 12 in this zone to melt and thus flow out of the ceramic shell mold 10 through a pour cup 14. The melted wax 12 may flow through the pour cup 14 due to gravity. Alternatively, the system may be arranged so that centrifugal or other forces are used in order to pull the melted wax 12 from the hot zone 18 out of the pour cup 14 or other opening to thus be removed from the ceramic shell mold 10.

The hot zone 18 is relatively small as compared to the cold zone 16 when initiating the dewaxing process. The cold zone 16 may be kept, in accordance with one exemplary embodiment, at room temperature during the dewaxing process. For example, the cold zone 16 may be from fifty to ninety degrees Fahrenheit in certain exemplary embodiments depending upon the melting temperature of the pattern material. Such temperatures impart little to no pressure on the inside of the ceramic shell mold 10 thus causing little or no stress thereon. The presence of the hot zone 18 creates a "mushy" layer of wax 12 in the hot zone 18 which separates the molten wax 12 front surface and cold zone 16. The melted wax 12 is in liquid form and thus flows from this portion of the wax pattern assembly 12 in the direction of gravity or as directed by other forces.

As shown in FIG. 1, the height of the internal ceramic shell mold 10 surface is designated by reference "a" and the width of the internal ceramic shell mold 10 surface is designated by reference "b." Expansion of the wax pattern assembly 12 places a pressure P, measured in force per unit area, on the internal surface of the ceramic shell mold 10. When heated completely, the total load F(t) or force on the internal surface of the ceramic shell mold 10 is approximately $F(t)=P\times\text{Total Area}=P\times a\times b=Pab$.

Heating of only the hot zone 18 causes a localized heating of the wax pattern assembly 12. The height of the hot zone 18 is designated by reference "d." Stresses imparted onto the ceramic shell mold 10 are minimized when only hot zone 18 is heated instead of the entire wax pattern assembly 12. The load or force when heating the hot zone 18 and not the cold zone 16 is $F(d)=P\times\text{area of hot zone}=P\times a\times d=Pad$.

Comparison of total heating versus local heating thus results in a ratio in which $F(d)/F(a)=Pad/Pab=d/b$. Therefore, if d is 10% of a, then the total force on the interior of the ceramic shell mold 10 is only 10% of the total force that would be experienced if the wax pattern assembly 12 were completely heated at once. Heating of the entire wax pattern assembly 12 at a once causes all of the heated forces to be distributed through the four sides of the ceramic shell mold 10 at the locations where stress concentrates. Ceramic shell mold 10 edge splits can occur at these locations. Reduction of the stresses imparted to the ceramic shell mold 10 may prevent these edge splits from occurring as reduced forces are imparted to areas that may otherwise receive a concentration of stress.

Figure 6:
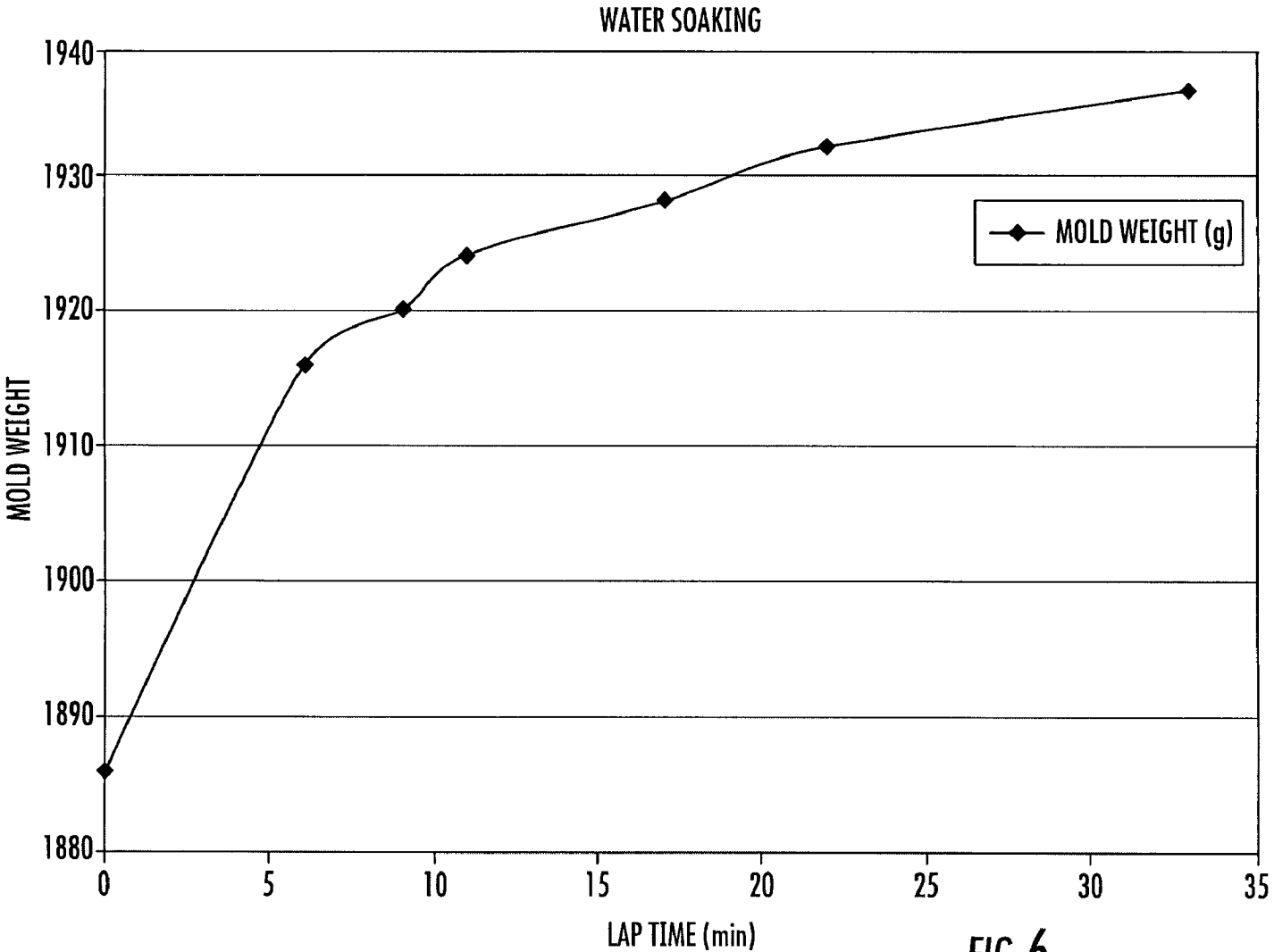
FIG. 6 is a graph showing the weight of the ceramic shell mold and wax pattern versus time of water saturation.

The ceramic shell mold 10 may be constructed so that it has some amount of porosity. In accordance with certain exemplary embodiments, the shell mold may have from 10% to 50% of its volume being open porosity. The ceramic shell mold 10 can have water applied thereon so that it becomes saturated. In this regard, the ceramic shell mold 10 may be immersed into a pool of water or may be sprayed with water. The wax pattern assembly 12 may be present in the ceramic shell mold 10 during saturation thereof. The pore size of the ceramic shell mold 10 may be in the micron and nanometer size range. Pore sizes in such ranges produce capillary forces that are high enough to allow water to be quickly and easily absorbed yet difficult to flow therefrom. FIG. 6 illustrates a graph showing the weight of the ceramic shell mold 10 and wax pattern assembly 12 in grams per length of soaking in minutes in one exemplary embodiment. However, it is to be understood that various amounts of soaking may be employed to achieve various degrees of absorption of water into the walls of the ceramic shell mold 10 in accordance with other exemplary embodiments. Water may be absorbed into the walls of the ceramic shell mold 10 at a quantity of from 5% to 100% of the water absorbing capacity of the walls of the ceramic shell mold 10 before immersion into the hot oil bath 20. In accordance with other exemplary embodiments, the water absorbing capacity may be from 40% to 60%, from 75% to 85%, from 85% to 95%, or from 95% to 100%.

Figure 2:
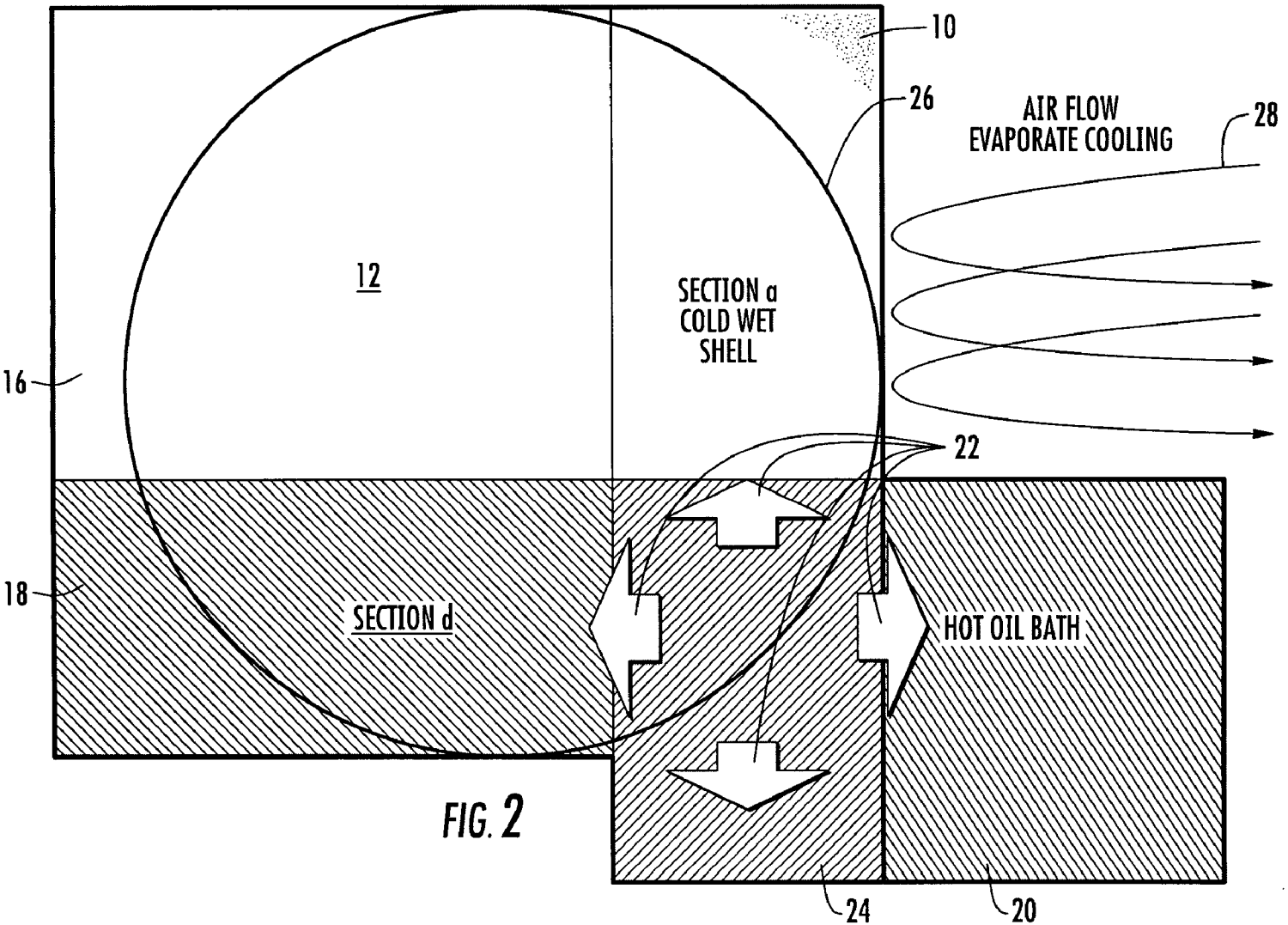
FIG. 2 is a detailed view of circle 2-2 of FIG. 1.

The soaked ceramic shell mold 10 with the included wax pattern assembly 12 may be placed into a hot oil bath 20 as illustrated in FIG. 2 which is a detailed view of circle 2-2 of FIG. 1. Here, the hot oil bath 20 is shown as being up to 500 degrees Fahrenheit, although it is to be understood that the hot oil bath 20 may have various temperatures in accordance with other exemplary embodiments. For example, the hot oil bath 20 may be up to three hundred degrees Fahrenheit or up to seven hundred degrees Fahrenheit in accordance with other exemplary embodiments. Dipping the ceramic shell mold 10 into the hot oil bath 20 the amount shown causes the hot zone 18 to be formed. A hot shell section 24 is thus generated as this portion of the ceramic shell mold 10 is located inside of the hot oil bath 20. The hot shell section 24 may have a temperature greater than two hundred fifteen degrees Fahrenheit when immersed into the hot oil bath 20 for a specific amount of time. Under most circumstances, the temperature of the hot oil bath 20 may be above two hundred and twelve degrees Fahrenheit so that absorbed water within the ceramic shell mold 10 can be converted into steam 22. Temperature elevation of the hot shell section 24 thus causes the water present within the hot shell section 24 to be converted into steam 22. The steam 22 and its associated heat are transferred from the hot shell section 24 through conduction to areas in contact therewith. As shown, steam 22 may move into the hot oil bath 20, the hot zone 18 of the wax pattern assembly 12 immediately to the left of the hot shell section 24, and upwards and downwards to other portions of the ceramic shell mold 10. The steam 22 has high vapor pressure which causes it to exit the area of the ceramic shell mold 10 at which it is generated.

Transfer of steam 22 into the hot zone 18 causes the wax pattern assembly 12 in the hot zone 18 to become hot enough so that this wax 12 begins to melt and be subsequently removed from the ceramic shell mold 10. Once some amount of space has been created within the ceramic shell mold 10 through the removal of a certain amount of wax pattern assembly 12, the steam 22 generated within the ceramic shell mold 10 can flow through the hot zone 18 so that heat from the hot oil bath 20 is effectively transferred into the wax pattern assembly 12 thus continuing localized heating of the hot zone 18 as desired. The steam 22 moves inward from the wall of the ceramic shell mold 10 and thus acts to force the melting wax pattern assembly 12 to the center of the ceramic shell mold 10 and out of the pour cup 14. If the steam 22 were not directed from the interior walls of the ceramic shell mold 10 inwards, melting wax 12 may accumulate or flow slowly on the walls of the ceramic shell mold 10 thus increasing the time it takes for removal. The steam 22 thus acts to wash out the melting wax pattern assembly 12 from the ceramic shell mold 10 due in part to its inwardly directed propagation.

Although shown as being a relatively straight boundary line between the cold zone 16 and hot zone 18, it is to be understood that the melting of wax 12 may not occur in such a uniform manner in certain exemplary embodiments. For example, the inner surface of the ceramic shell mold 10 may heat up first, thus causing wax 12 adjacent the inner surface to melt first. Wax 12 located away from the inner surface will then subsequently melt so that the resulting shape of the wax 12 in the hot zone 18 is generally cone shape. As such, it is to be understood that a completely uniform, linear melting of the wax 12 may not be realized in accordance with certain exemplary embodiments. The geometric shape of the hot zone 18 may be varied in accordance with different exemplary embodiments. Generally, the volume of the hot zone 18 is small with respect to the size of the cold zone 16 at least when the melting processes initiates. In certain exemplary embodiments, the hot zone 18 may include a portion that is a hot melt zone at which the wax 12 melts and a hot empty zone at which the wax 12 has already melted and flowed from the ceramic shell mold 10. The size of the hot empty zone of the hot zone 18 may be large as compared to the cold zone 16 when about half or more of the process is completed. The hot melt zone of the hot zone 18 is generally small compared to the cold zone 16 in size during the dewaxing process.

An air flow 28 may be induced above the hot oil bath 20. The air flow 28 may be directed against a cold shell section 26 of the ceramic shell mold 10 in order to maintain a cool temperature of the cold shell section 26 so that resulting heating and stresses do not occur in the cold zone 16 of the wax pattern assembly 12. The presence of the water within the cold shell section 26 further acts to reduce the temperature of this portion of the system. Here, the flow of air 28 against the saturated cold shell section 26 causes evaporation which in turn facilitates additional cooling of the cold shell section 26. As such, the amount of air flow 28 may be varied to ensure that the cold shell section 26 maintains a desired temperature so that heating and associated stresses of certain portions of the ceramic shell mold 10 are not realized.

The cold zone 16 may be maintained at a temperature so that wax 12 located therein is not melted. As such, pressure from thermal expansion of wax 12 in the cold zone 16 is reduced or eliminated on the ceramic shell mold 10 so that resulting stresses are not realized thereon. The cold zone 16 may be kept at room temperature while the hot zone 18 is hot enough to melt the wax 12 therein. The amount of air flow 28 may be selected so that the appropriate temperature of the cold zone 16 is realized. The air flow 28 may also function to remove heat away from the system. The evaporation of water due to the air flow 28 may function to balance the temperature of the ceramic shell mold 10 with respect to heat imparted by the hot oil bath 20 so that melting of the wax 12 is controlled in a desired manner.

As such, a pair of temperature zones 16 and 18 are generated through the use of the water soaked ceramic shell mold 10 to result in low stress dewaxing. The amount of water within the ceramic shell mold 10 may be varied in accordance with certain exemplary embodiments. For example, the ceramic shell mold 10 may be completely saturated so that it cannot hold any more water in accordance with certain versions of the system. In accordance with other embodiments, the ceramic shell mold 10 may be filled with water from 25% to 75% of its maximum water absorbing capacity.

Although shown as a hot oil bath 20, it is to be understood that various heating sources may be used in accordance with other exemplary embodiments. For example, superheated air or flame can be used to generate the necessary heat for the system. The speed at which the steam 22 is generated depends upon the temperature of the hot oil bath 20 or other heating source employed. A higher the temperature of the hot oil bath 20 causes faster steam 22 generation. The ceramic shell mold 10 and the wax pattern assembly 12 can be further lowered into the hot oil bath 20 once all of the wax 12 in the hot zone 18 has been melted and removed. The rate of immersion of the ceramic shell mold 10 and the wax pattern assembly 12 causes the cold zone 16/hot zone 18 boundary to move up at a matching rate to correspond to the melting and draining of wax 12 from the ceramic shell mold 10. The ceramic shell mold 10 and wax pattern assembly 12 can be lowered into the hot oil bath 20 to a point at which all of the wax 12 has melted and drained from the ceramic shell mold 10. The ceramic shell mold 10 and wax mold 12 may be lowered into the hot oil bath 20 at varying rates of immersion. For example, the ceramic shell mold 10 and the wax pattern assembly 12 may be lowered at a rate from 0.1 inches per minute to 10 inches per minute in accordance with certain exemplary embodiments. In accordance with certain exemplary embodiments, the rate of dewaxing is one inch per minute. In accordance with other exemplary embodiments, the rate of immersion may be from one half inch per minute to two inches per minute.

Although shown as having the pour cup 14, it is to be understood that the pour cup 14 need not be present in accordance with other exemplary embodiments. The pour cup 14 is simply an opening that allows the wax 12 to drain from the ceramic shell mold 10. The pour cup 14 may be straight in shape in accordance with other exemplary embodiments. Such a configuration is sometimes referred to as a collar. The pour cup 14 may be variously shaped or completely missing in accordance with certain embodiments of the system.

Figure 3:
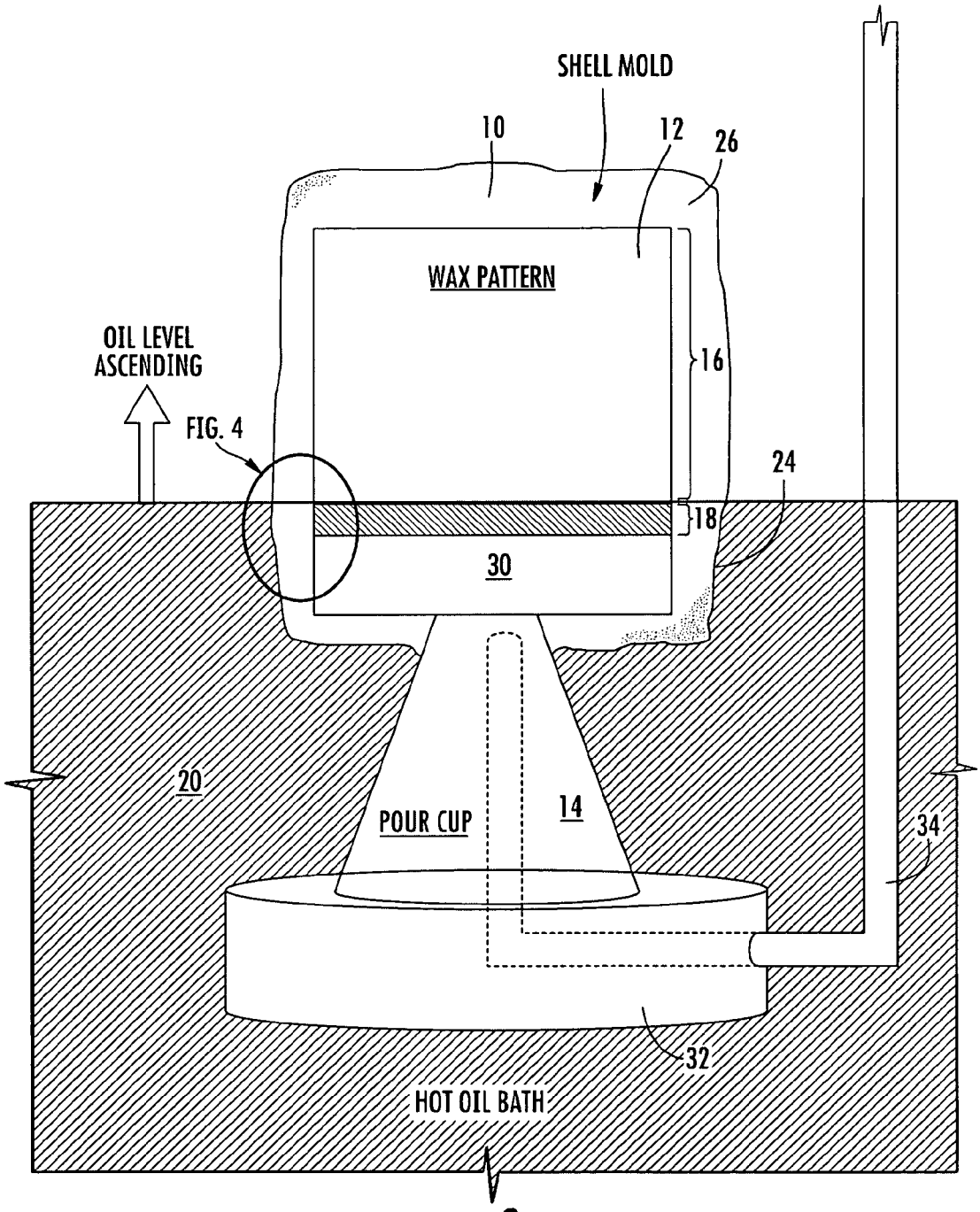
FIG. 3 is a side schematic view of a dewaxing process in accordance with another exemplary embodiment.

FIG. 3 illustrates another exemplary embodiment of the system for dewaxing. The ceramic shell mold 10 with the wax 12 is dipped into a hot oil bath 20 in order to generate steam 22 for localized heating and melting of the wax 12 so that stresses on the ceramic shell mold 10 are reduced. As wax 12 is melted and exits the ceramic shell mold 10, an empty space 30 of the ceramic shell mold 10 is produced immediately below the hot zone 18. Melted wax drains via gravity through the pour cup 14 and into a wax collection area 32 for subsequent reuse or disposal. A venting tube 34 is located through the pour cup 14 and extends out of the hot oil bath 20. The venting tube 34 functions to impart atmospheric pressure to the pour cup 14 and the empty space 30. Conversion of water into steam 22 through heating causes the steam 22 to tend to move to an area of lower pressure. Manipulation of the pressure of the system at various locations may function to direct the flow of steam 22 and related heat to desired locations.

Although disclosed as having a venting tube 34, this tube need not be present in other embodiments. For example, the previously described embodiment in FIG. 1 does not have the venting tube 34. Further, the venting tube 34 need not be located within the pour cup 14 but may simply be placed into fluid communication therewith so that atmospheric pressure into the pour cup 14 and the empty space 30 can be realized. Further, the presence of the venting tube 34 may function to allow steam 22 generated in the system a path of exit to the atmosphere. In this regard, a certain amount of steam 22 may be vented to the atmosphere through the venting tube 34 without heating the cold zone 16 or other portions of the system that are not desired to be heated.

The wax collection area 32 may be a sealed container 32 that does not let oil from the hot oil bath 20 therein when immersed. The venting tube 34 may be located in the sealed container 32 at a location so that atmospheric pressure and venting is imparted into the sealed container 32 and the ceramic shell mold 10 and so that melting wax 12 does not enter the venting tube 34. The sealed container 32 may be sealed with the pour cup 14 and the empty space 30 of the ceramic shell mold 10 so that oil cannot flow therein. The sealed container 32 thus functions to collect melted wax 12 and to impart a desired pressure to the interior of the ceramic shell mold 10 and also provides a conduit for steam 22 to escape as desired.

The system may be designed so that steam 22 is directed towards the wax pattern assembly 12 and not into the hot oil bath 20 when generated. In this regard, the pressure in the ceramic shell mold 10, for instance in the empty space 30 or in the pour cup 14, can be maintained at a lower level than the pressure in the hot oil bath 20. This pressure differential may tend to direct the steam 22 to the desired area in the system. The portion of the ceramic shell mold 10 located in the hot oil bath 20 will experience a pressure thereon that is based, in part, upon its depth under the surface of the hot oil bath 20. The side of the ceramic shell mold 10 on the opposite side of the hot oil bath 20, for instance in the empty space 30, may have a pressure of one atmosphere due to the presence of the venting tube 34. The empty space 30 and the interior of the ceramic shell mold 10 is sealed from the hot oil bath 20. The pressure difference between the internal and external surfaces of the ceramic shell mold 10 at the hot zone 18 section is its depth into the hot oil bath 20 times the density of the hot oil bath 20. The hot oil bath 20 side of the ceramic shell mold 10 may have a higher pressure than the internal side of the ceramic shell mold 10 thus causing the majority of the steam 22 generated in the hot shell section 24 to blast into the wax side of the ceramic shell mold 10. This direction of steam 22 may function to increase the amount of heat transferred to the hot zone 18 and thus enhance drainage of the wax 12. Further, this direction of steam 22 via a pressure differential may function to maximize the heat transferred into the wax 12 so that a thinner, and less stressful, hot zone 18 is realized.

Figure 4:
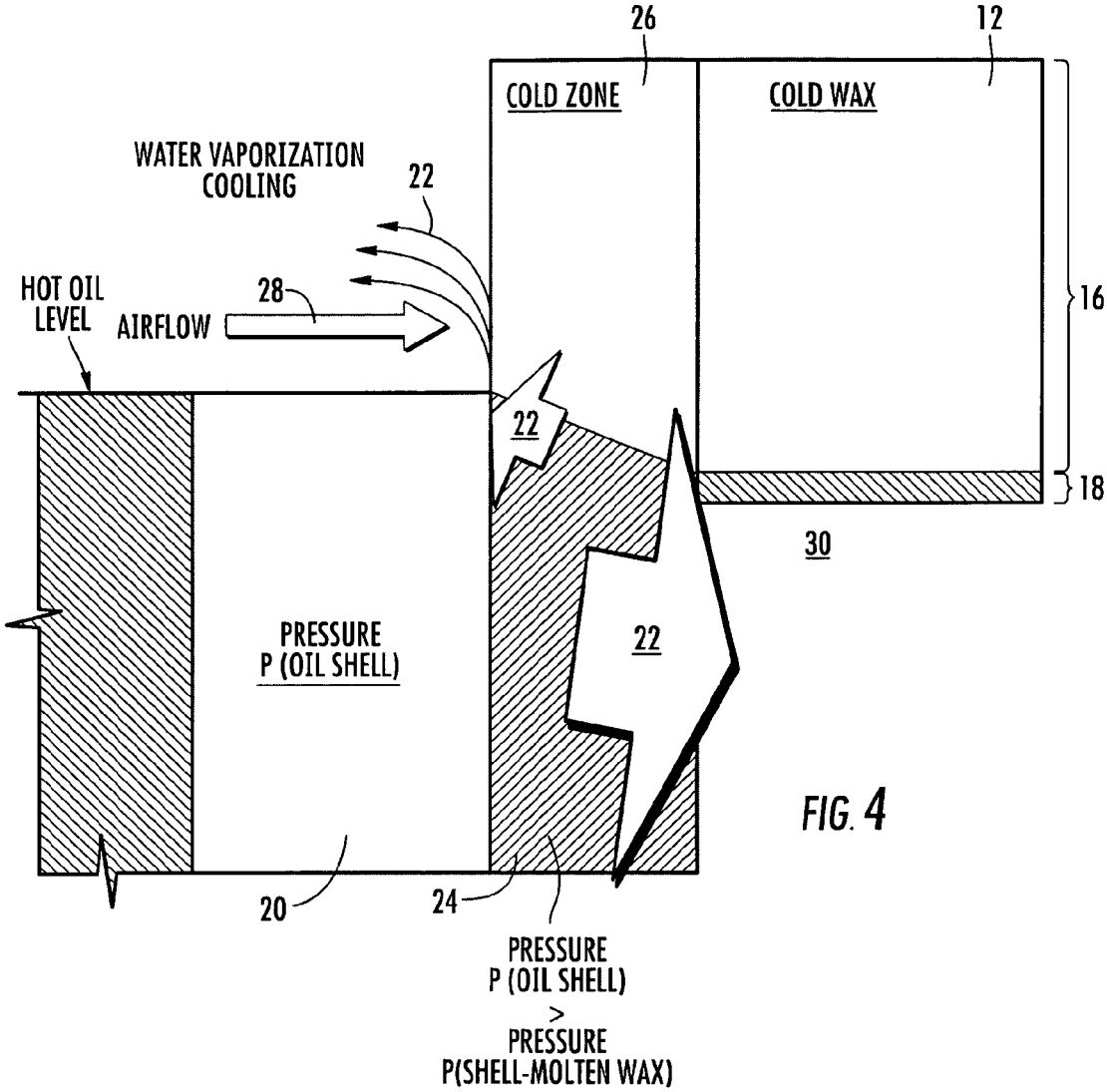
FIG. 4 is a detailed view of circle 4-4 of FIG. 3.

FIG. 4 is a detailed view of circle 4-4 of FIG. 3 that shows the direction of generated steam 22 as being into the empty space 30 and the hot zone 18 within the ceramic shell mold 10. Although described as being maintained at atmospheric pressure, it is to be understood that the interior portions of the system such as the hot zone 18, pour cup 14, and empty space 30 may be maintained at pressures other than atmospheric. The system may thus be arranged to be capable of working at various pressures so long as the pressure on the inside is less than that on the outside so that generated steam 22 is directed in a desired manner. Although described as employing a pressure differential, it is to be understood that a pressure differential is not present in accordance with other exemplary embodiments. For example, the pressure on the inside of the ceramic shell mold 10 may be the same as the pressure outside of the ceramic shell mold 10, for instance in the hot oil bath 20. In such circumstances, steam 22 will still be generated and heat transfer will still take place.

Figure 7:
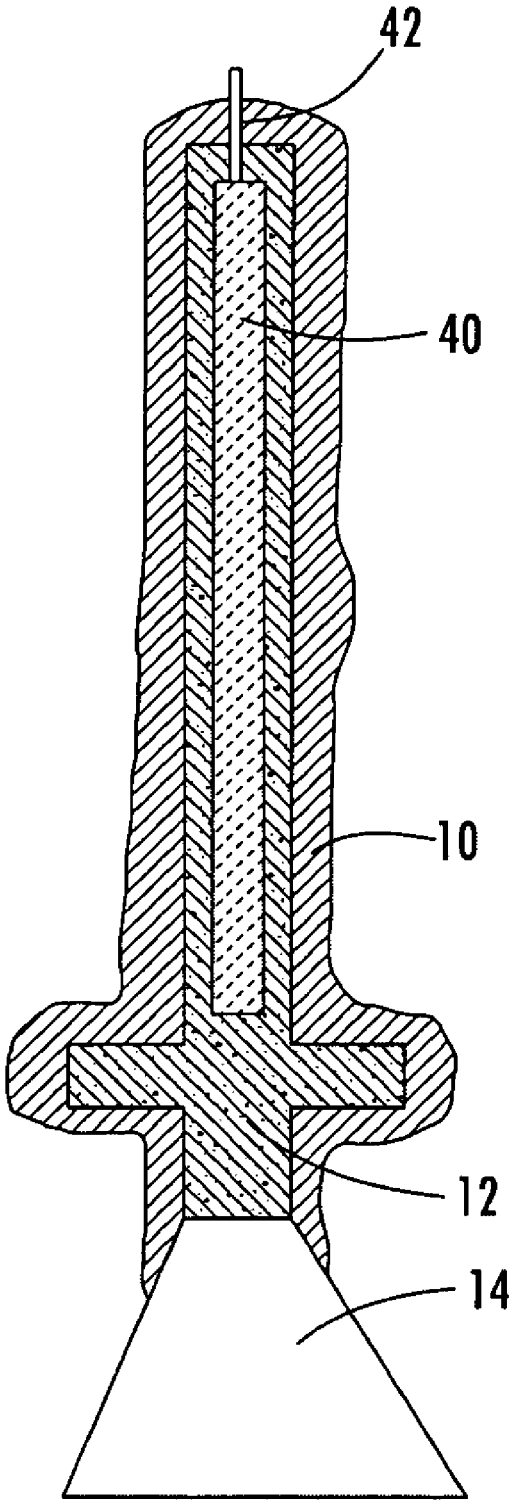
FIG. 7 is a side schematic view of a ceramic shell mold with a ceramic core in accordance with another exemplary embodiment.

FIG. 7 illustrates an exemplary embodiment in which a ceramic core 40 is present within the wax pattern assembly 12. The ceramic core 40 is attached to the ceramic shell mold 10 through the use of a pin 42. The ceramic core 40 is provided in order to create various geometries for casting. The ceramic core 40 may have pressure exerted thereon by the wax pattern assembly 12 during the dewaxing process. The localized nature of the heating may cause an equal amount of pressure to be imparted to all sides of the ceramic core 40 so that the position of the ceramic core 40 will not shift within the ceramic shell mold 10 and/or the ceramic core 40 will not be damaged during the dewaxing process.

The system may allow for dewaxing to occur at low steam 22 temperatures so that chemical and mechanical damage to the ceramic shell mold 10 facecoat and ceramic core 40 may be reduced. The enclosed mold cavity and venting system may allow for the elimination of foreign objects that could possibly enter the cavity of the ceramic shell mold 10 and result in casting defects. The melted wax pattern assembly 12 can be collected and reused if desired. Further, the system may allow for thinner ceramic shell molds 10 to be used since stresses thereon may be reduced. The use of thinner ceramic shell molds 10 can reduce hot-tear and RX defects that may otherwise be realized. Further, the use of a hot oil bath 20 instead of an autoclave may allow for safer operation with less maintenance. However, it is to be understood that other exemplary embodiments are possible in which an autoclave may be used.

Experiments Carried Out in Accordance with Certain Exemplary Embodiments

Figure 5A:
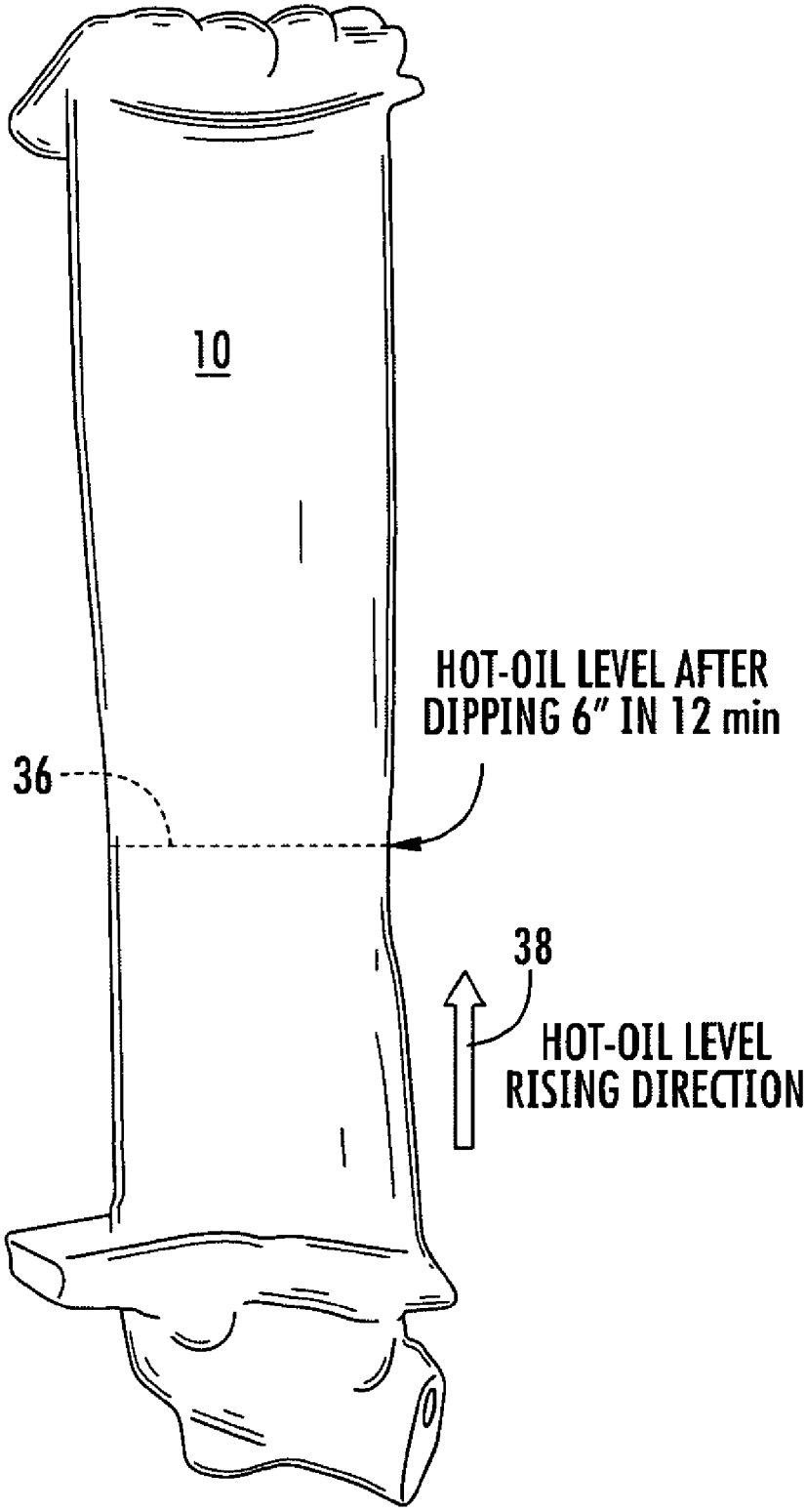
FIG. 5*a* is a side view of a ceramic shell mold after a portion was immersed into a hot oil bath in accordance with one exemplary embodiment.

A method was carried out in accordance with one exemplary embodiment in order to observe the performance of the present system. Soy oil 20 was pre-heated to a temperature of approximately 250-350 degrees Fahrenheit. A fifteen inch long ceramic blade shell mold 10 was soaked in water for ten minutes and then subsequently drained for ten minutes. The wetted ceramic blade shell mold 10 was then oriented vertically and dipped into the hot soy oil bath 20 at a rate of approximately 0.5 inches per minute. The direction of the rising hot soy oil bath 20 with respect to the ceramic blade shell mold 10 is shown in FIG. 5*a* by arrow 38. A fan provided an air flow 28 above the surface of the hot soy oil bath 20.

The temperature of the ceramic blade shell mold 10 above the surface of the soy oil bath 20 was measured throughout the process. After six inches of the ceramic blade shell mold 10 was dipped into the soy oil bath 20, the process was stopped and the ceramic blade shell mold 10 was removed and its edges were inspected. The ceramic blade shell mold 10 was then subsequently cut and inspected.

Figure 5B:
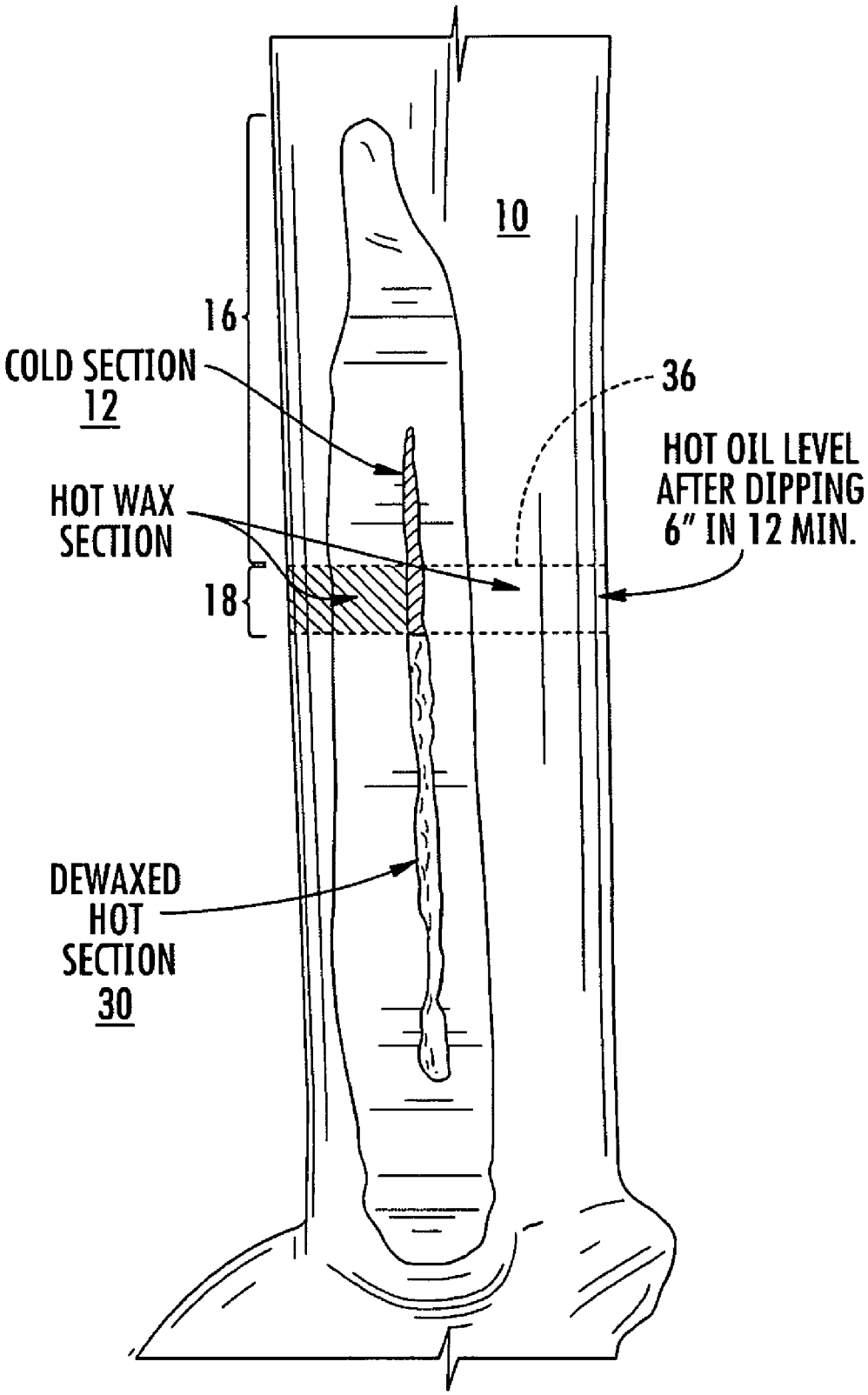
FIG. 5*b* is a side view of the ceramic shell mold of FIG. 5*a* with a section removed therefrom in order to view a portion of the interior of the ceramic shell mold.

Measurement and inspection of the ceramic blade shell mold 10 indicated that the cold shell section 26 above the surface of the soy oil bath 20 had less than ten degrees (+/− five degrees) Fahrenheit of temperature change. This temperature monitoring took place at a location one half inch above the surface of the soy oil bath 20. Cracks to the ceramic blade shell mold 10 were not observed. Mild steam bubbles were observed around the ceramic blade shell mold 10 when the wet ceramic blade shell mold 10 was dipped into the hot soy oil bath 20. FIG. 5*b* illustrates the ceramic blade shell mold 10 with a cut section to show the cold zone 16 and hot zone 18 realized at the maximum dipping level imparted to the ceramic blade shell mold 10. An empty space 30 was observed at a point below the hot zone 18. The boundary line between the cold zone 16 and hot zone 18 was observed at approximately six inches. The boundary line is represented by a hot oil line 36 in FIGS. 5*a* and 5*b* that marks the transition between these two areas. The hot zone 18 was measured to have a thickness of approximately one half inch. Almost all of the ceramic blade shell mold 10 that was immersed was dewaxed. The estimated ratio of stress imparted to the ceramic blade shell mold 10, as opposed to a normal autoclave dewaxing process, was 0.5/15 which is equal to a ratio of 1/30.

Other methods carried out in accordance with still further exemplary embodiments were made to arrive at additional examples. Twenty different configuration types of EQ molds 10 were dewaxed with hot oil baths 20 ranging in temperatures from 250 degrees Fahrenheit to 350 degrees Fahrenheit. Certain of those configurations of ceramic shell molds 10 typically had 70% to 100% shell splits using conventional dewaxing methods. When dewaxed according to methods disclosed herein, 0% shell splits were achieved. The immersion rates used were 0.5 inches per minute, 1 inch per minute, and 2 inches per minute in accordance with various exemplary embodiments with successful results. After fired at 1600 degrees Fahrenheit, the ceramic shell molds 10 were inspected and cracking was not observed.

In another experiment carried out in accordance with another exemplary embodiment, a single crystal shell mold 10 was dewaxed according to a method disclosed herein. The temperature of the hot oil bath 20 was 300 degrees Fahrenheit. The ceramic shell mold 10 was soaked in water prior for ten minutes and then drained for less than ten minutes. The rate of decent into the hot oil bath 20 was one inch per minute. After fired at 1600 degrees Fahrenheit, the ceramic shell molds 10 were inspected and no cracking was observed.

An additional experiment was conducted in which molds 10 that contained two cored, multi-vane segment patterns 12 were produced using a conventional seven layer plus a cover layer ceramic shell mold 10. Flash dewax was used to remove the wax patterns 12 by inserting the molds 10 into a 1600° F. furnace and holding at that temperature for one hour. It was noted that approximately 60% of the castings were scrapped for failure to meet casting wall thickness specifications due to failure of one or more of the preformed ceramic cores.

A further experiment was carried out in accordance with another exemplary embodiment in which molds 10 equivalent to those produced in the experiment mentioned in the last experiment were dewaxed using a low stress dewax process as disclosed herein. The ceramic shell molds 10 were soaked in tap water for 15 minutes and then immersed into 340° F. SOYEASY® quench oil 20 at a rate of 2"/minute. The ceramic shell molds 10 were held for one minute and removed from the oil 20. The ceramic shell molds 10 were immediately inserted into a 1600° F. furnace and held at that temperature for one hour. Post-casting scrap rates due to failure to meet casting wall thickness specifications were reduced to <5% of parts cast due to decreases in stresses causing core failure during the dewaxing process.

An additional experiment was conducted in which molds 10 that contained eight, shrouded blade patterns were produced using a conventional eight layer plus a cover ceramic shell mold 10. A flash dewax waxing process was used to remove the wax patterns 12 by inserting the molds 10 into a 1600° F. furnace and holding at that temperature for one hour. After flash dewax approximately 75% of the molds 10 contained externally visible cracks that required repair patching prior to casting.

A further experiment in accordance with another exemplary embodiment as described herein was performed. Six equivalent molds 10 to those produced in the experiment mentioned in the last paragraph were dewaxed using the low stress dewax process as disclosed herein. The molds 10 were soaked in tap water for 15 minutes and then immersed into 340° F. SOYEASY® quench oil 20 at a rate of 2"/minute. The molds 10 were held for one minute and removed from the oil 20. The molds 10 were immediately inserted into a 1600° F. furnace and held at this temperature for one hour. None of the molds 10 contained externally visible cracks.

Another experiment was conducted. Here, molds 10 containing 56 small, cored blade patterns were produced using a conventional seven layer plus a cover ceramic shell mold 10. The cores contained a small fused silica rod. The molds 10 were dewaxed in a steam autoclave using 90 psi steam pressure. The molds 10 were then rerun through the same autoclave cycle a second time. After mold preheat and casting, approximately 25% of the castings were scrapped because the fused silica rod failed which resulted in a failure to meet casting wall thickness specifications.

An additional experiment in accordance with another exemplary embodiment was conducted with molds 10 equivalent to those previously discussed in the previous paragraph. A mold was dewaxed using the low stress dewax process as described herein. The molds 10 were soaked in tap water for 15 minutes and then immersed into 340° F. SOYEASY® quench oil 20 at a rate of 2"/minute. The mold was held for one minute and removed from the oil 20. The mold was then immediately inserted into a 1600° F. furnace and held at this temperature for one hour. After casting only one component (<2%) was scrapped for failure to meet casting wall thickness specifications because of failure of the fused silica rod.

Another example in accordance with another exemplary embodiment was carried out in which two molds 10 containing 20 small airfoil blade patterns were produced using a conventional seven layer plus a cover ceramic shell mold 10.

The molds 10 were soaked in tap water for 15 minutes and then immersed into 340° F. SOYEASY® quench oil 20 at a rate of 1.5"/minute, held for 1.5 minute, and then removed from the oil 20. The molds 10 were immediately inserted into a 1600° F. furnace and held at this temperature for one hour. The molds 10 had small cracks near the root of all of the airfoils after burnout at 1600° F. Examination of the molds 10 indicated that a portion of the wax pattern 12 in this area would melt as it was immersed into the hot oil 20 without an open path to exit the mold, as it entered the oil 20 before the portion of the mold that provided the only possible path. This molten wax 12 was blocked by solid wax 12 and as it melted it expanded and stressed the mold. This demonstrated that casting molds 10 to be used with the disclosed dewaxing process may need to be designed to eliminate volumes of trapped molten wax.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A system comprising:

a ceramic shell mold having a wall including a first portion and a second portion opposite the first portion, wherein water is present within the wall of the ceramic shell mold;

a wax pattern located within the ceramic shell mold; and a heat source configured to receive the first portion of the wall of the ceramic shell mold therein and convert at least a portion of the water within the wall of the ceramic shell mold into steam for use in melting at least a portion of the wax pattern; and a pour cup engaging the ceramic shell mold and arranged such that melted wax of the wax pattern flows out of the ceramic shell mold and through the pour cup, wherein the first portion of the wall of the ceramic shell mold is proximate the pour cup and the second portion of the wall is spaced apart from the pour cup such that a direction of heat flow through the wall is from the first portion to the second portion.

2. The system as set forth in claim 1, wherein the wall of the ceramic shell mold has water applied thereon before heating with the heat source, and further comprising a ceramic core that is located in the wax pattern, and wherein the steam has a temperature greater than 212 degrees Fahrenheit.

3. The system as set forth in claim 1, wherein the heat source is a hot oil bath into which the ceramic shell mold is immersed, wherein the temperature of the hot oil bath is from 250 to 500 degrees Fahrenheit.

4. The system as set forth in claim 3, wherein the ceramic shell mold and wax pattern are immersed into the hot oil bath at a rate from 0.1 to 5.0 inches per minute.

5. The system as set forth in claim 1, wherein the wax pattern and the ceramic shell mold define a space, and wherein the space is maintained at a lower pressure than the outside of the portion of the wall that is heated by the heat source such that at least a portion of the steam generated within the wall of the ceramic shell mold is drawn into the space.

6. The system as set forth in claim 1, further comprising an air flow configured for being directed against the outside of the portion of the wall of the ceramic shell mold that is not configured for being heated by the heat source, wherein the air flow is configured to lower the temperature of the portion of the wall of the ceramic shell mold that is not configured for being heated by the heat source.

7. The system as set forth in claim 1, further comprising:

a venting tube configured for maintaining the interior of the ceramic shell mold at atmospheric pressure, wherein the venting tube is configured to allow the steam to vent from the interior of the ceramic shell mold; and a sealed container configured to receive melted wax from the pour cup and store the melted wax therein, wherein the heat source is a hot oil bath, and wherein the sealed container is sealed such that oil from the hot oil bath is prevented from entering the interior of the sealed container.

8. A system for dewaxing, comprising:

a ceramic shell mold having a wall;

a wax pattern assembly located within the ceramic shell mold;

a hot oil bath, wherein the ceramic shell mold is located within the hot oil bath, wherein a hot shell section is established at the portion of the ceramic shell mold located within the hot oil bath, and wherein a cold shell section is established at the portion of the ceramic shell mold not located within the hot oil bath, wherein the hot oil bath functions to transfer heat through the ceramic shell mold and into the wax pattern assembly in order to melt the wax pattern; and a wax collection area located in the hot oil bath, wherein melted wax from the wax pattern assembly is transferred into the wax collection area and stored in the wax collection area.

9. The system as set forth in claim 8, wherein the wax collection area is a sealed container that is completely immersed in the hot oil bath, wherein the sealed container is configured such that oil from the hot oil bath is prevented from entering the interior of the sealed container.

10. The system as set forth in claim 9, further comprising:

a ceramic core located in the wax pattern assembly; and a pour cup disposed between the ceramic shell mold and the sealed container, wherein melted wax from the wax pattern assembly flows through the pour cup and into the sealed container, wherein the pour cup is completely immersed in the hot oil bath;

wherein the wall of the ceramic shell mold has water applied thereon before heating with the hot oil bath, wherein the temperature of the hot oil bath is from 212 to 500 degrees Fahrenheit, wherein the ceramic shell mold and wax pattern assembly are immersed into the hot oil bath at a rate from 0.1 to 5.0 inches per minute, and wherein steam formed from heat transferred to the water from the hot oil bath is generated.

11. The system as set forth in claim 10, further comprising a venting tube in communication with the interior of the ceramic shell mold, wherein the venting tube is disposed through the sealed container and the pour cup, wherein the venting tube functions to vent the interior of the ceramic shell mold to the atmosphere such that the interior of the ceramic shell mold is maintained at atmospheric pressure.

12. The system as set forth in claim 8, wherein water is present in the wall of the ceramic shell mold, and wherein the water is converted into steam at the hot shell section of the ceramic shell mold, wherein the steam functions to transfer heat to the wax pattern assembly for use in melting the wax pattern, wherein the steam has a temperature greater than 212 degrees Fahrenheit.

13. The system as set forth in claim 12, wherein the wax pattern assembly and the ceramic shell mold define a space, and wherein the space is maintained at a lower pressure than the pressure exerted onto the hot shell section of the ceramic shell mold by the hot oil bath, wherein at least a portion of the steam generated at the hot shell section is drawn into the space by the pressure differential.

14. The system as set forth in claim 12, wherein the wall of the ceramic shell mold is saturated with water prior to application with the hot oil bath.

15. The system as set forth in claim 8, further comprising an air flow directed against the cold shell section of the ceramic shell mold, wherein the air flow acts to cool the cold shell section.

16. A method comprising:

providing a ceramic shell mold having a wall;

applying water to the wall such that water is absorbed into the wall; and immersing a portion of the ceramic shell mold into a hot oil bath so as to form a hot shell section of the ceramic shell mold, wherein the water in the wall of the hot shell section is converted into steam.

17. The method as set forth in claim 16, wherein the immersing step is performed at a rate from 0.1 to 5.0 inches per minute, and wherein the immersing starts at a portion of the ceramic shell mold that has a mold opening, wherein the hot oil bath has a temperature from 212 to 500 degrees Fahrenheit.

18. The method as set forth in claim 16, further comprising cooling the portion of the wall of the ceramic shell mold that is not immersed in the hot oil bath with an air flow, wherein the step of maintaining the space includes maintaining the space at atmospheric pressure.

19. The method as set forth in claim 16, further comprising maintaining a space within the ceramic shell mold at a pressure lower than the pressure on the outside of the hot shell section such that steam formed in the hot shell section is drawn into the space, wherein the steam melts a wax pattern assembly in the ceramic shell mold.

20. The method as set forth in claim 16, further comprising:

collecting melted wax in a sealed container that is completely immersed within the hot oil bath, wherein the sealed container is sealed such that oil of the hot oil bath is prevented from contacting the melted wax in the sealed container; and venting steam from the space within the ceramic shell mold.

21. An apparatus comprising:

a hot fluid bath;

a shell mold having a wax body disposed therein, the shell mold including first and second portions, the first portion being received in the hot fluid bath and the second portion being disposed outside of the hot fluid bath, the hot fluid bath transferring heat through the first portion and into the wax body to melt the wax body, the first portion having a first temperature, and the second portion having a second temperature that is lower than the first temperature; and a pour cup through which melted wax from the wax body flows, the pour cup being disposed adjacent the first portion.

22. The apparatus of claim 21, wherein a wall of the shell mold has water applied thereon before being heated by the hot fluid bath, wherein the temperature of the hot fluid bath is between about 212 and 500 degrees Fahrenheit, the shell mold and wax body being immersed into the hot fluid bath at a rate of between about one-tenth of an inch per minute and about five inches per minute, and wherein steam is generated from heat transferred to the water from the hot fluid bath.

* * * * *